US011668029B2

(12) United States Patent
Gerth et al.

(10) Patent No.: US 11,668,029 B2
(45) Date of Patent: Jun. 6, 2023

(54) DEVICE AND METHOD FOR HANDLING WEAVING HARNESS ELEMENTS

(71) Applicant: Groz-Beckert KG, Albstadt (DE)

(72) Inventors: Christian Gerth, Meersburg (DE); Stefan Kailer, Meßstetten (DE); Bernd Pfeffer, Haigerloch (DE); Michael Acker, Albstadt (DE); Karl-Heinz Gesing, Raesfeld (DE)

(73) Assignee: GROZ-BECKERT KG, Albstadt (DE)

( * ) Notice: Subject to any disclaimer, the term of this patent is extended or adjusted under 35 U.S.C. 154(b) by 0 days.

(21) Appl. No.: 17/620,018

(22) PCT Filed: Jun. 15, 2020

(86) PCT No.: PCT/EP2020/066487
§ 371 (c)(1),
(2) Date: Dec. 16, 2021

(87) PCT Pub. No.: WO2020/254247
PCT Pub. Date: Dec. 24, 2020

(65) Prior Publication Data

US 2022/0205150 A1 Jun. 30, 2022

(30) Foreign Application Priority Data

Jun. 19, 2019 (EP) ..... 19181175

(51) Int. Cl.
*D03J 1/14* (2006.01)

(52) U.S. Cl.
CPC ..... *D03J 1/14* (2013.01)

(58) Field of Classification Search
None
See application file for complete search history.

(56) References Cited

U.S. PATENT DOCUMENTS 3,681,825 A * 8/1972 Meierhofer ..... D03J 1/14 28/206
3,744,109 A * 7/1973 Dohi ..... D03J 1/14 28/206

(Continued)

FOREIGN PATENT DOCUMENTS

CH 685203 A5 4/1995
CN 1271398 A 10/2000

(Continued)

OTHER PUBLICATIONS

International Search Report and Written Opinion dated Oct. 1, 2020, in corresponding International Application No. PCT/EP2020/066487, with machine English translation (16 pages).

(Continued)

*Primary Examiner* — Khoa D Huynh
*Assistant Examiner* — Grace Huang
(74) *Attorney, Agent, or Firm* — Fitch, Even, Tabin & Flannery LLP

(57) ABSTRACT

A device and a method for handling weaving accessories are described herein. The device comprises at least one holding element for a weaving accessory. The at least one holding element comprises a contact surface for a weaving accessory. The greater extension of the contact surface defines the longitudinal direction of the holding element and the lesser extension of the contact surface defines the lateral direction of the holding element. The at least one holding element is arranged pivotably around a first axis, which extends at a right angle to the holding element's longitudinal direction. A weaving accessory at the holding element's contact surface can thus be moved from a pick-up position to a drawing-in position by pivoting the holding element around the first axis.

8 Claims, 3 Drawing Sheets

(56) References Cited

U.S. PATENT DOCUMENTS

| | | | | | |
|---|---|---|---|---|---|
| 4,038,729 | A * | 8/1977 | Townsend | D03J 1/14 | 28/107 |
| 4,047,270 | A * | 9/1977 | John | D03J 1/14 | 414/797 |
| 4,233,716 | A * | 11/1980 | Patel | D03J 1/14 | 28/187 |
| 4,499,638 | A * | 2/1985 | John | D03J 1/14 | 28/207 |
| 4,520,539 | A * | 6/1985 | John | D03J 1/14 | 28/206 |
| 4,760,628 | A * | 8/1988 | Kaufmann | D03J 1/14 | 28/208 |
| 4,891,871 | A * | 1/1990 | Tachibana | D03J 1/14 | 28/205 |
| 5,136,762 | A * | 8/1992 | Gironi | D03J 1/14 | 28/201 |
| 5,184,380 | A * | 2/1993 | Benz | D03J 1/14 | 28/205 |
| 5,287,605 | A | 2/1994 | Badertscher et al. | | |
| 5,353,487 | A * | 10/1994 | Choh | D03J 1/14 | 28/208 |
| 5,448,812 | A * | 9/1995 | Wolf | D03J 1/14 | 28/208 |
| 5,475,906 | A * | 12/1995 | Magdika | D03J 1/14 | 28/208 |
| 5,839,606 | A * | 11/1998 | Kuroyanagi | D03J 1/14 | 221/268 |
| 6,199,249 | B1 * | 3/2001 | Gauer | D03J 1/14 | 28/208 |
| 6,230,377 | B1 * | 5/2001 | Tanno | D03J 1/14 | 28/208 |
| 2007/0079887 | A1 * | 4/2007 | Korbutt | D03C 9/02 | 139/93 |

FOREIGN PATENT DOCUMENTS

| | | | |
|---|---|---|---|
| CN | 1312869 | A | 9/2001 |
| CN | 1317060 | A | 10/2001 |
| CN | 106435943 | A | 2/2017 |
| CN | 205999570 | U | 3/2017 |
| EP | 0777005 | A2 | 6/1997 |
| EP | 0806506 | A2 | 11/1997 |
| EP | 1105558 | A1 | 6/2001 |
| EP | 1105558 | B1 | 10/2002 |
| WO | 9205303 | A1 | 4/1992 |
| WO | 0011252 | A1 | 3/2000 |

OTHER PUBLICATIONS

European Search Report and Written Opinion dated Nov. 28, 2019, in corresponding European Application No. 19181175.1, with machine English translation (11 pages).

European Intent to Grant dated Nov. 22, 2021, in corresponding European Application No. 19181175.1, with machine English translation (69 pages).

Chinese Patent Office, Office Action and Search in corresponding Chinese Application No. 202080044581.2 dated Aug. 12, 2022; 9 pages.

* cited by examiner

DEVICE AND METHOD FOR HANDLING WEAVING HARNESS ELEMENTS

CROSS REFERENCE TO RELATED APPLICATIONS

This patent application is the national phase of PCT/EP2020/066487, filed Jun. 15, 2020, which claims the benefit of European Patent Application No. 19181175.1, filed Jun. 19, 2019.

TECHNICAL FIELD

The present invention relates to a device, such as a drawing-in machine, for handling weaving accessories and a method for handling weaving accessories.

BACKGROUND

A drawing-in machine is a machine for drawing threads or warp threads into weaving accessories. It can be broken down into various functional units and comprises corresponding devices and components thereof. These include, for example, devices for the supply of healds and drop wires through which the threads will be drawn. In these supply devices, the weaving accessories are suspended contiguously on rail-like guideways, as is generally the case, for example, for sales purposes or during weaving. On the so-called "loading side", additionally, a device is needed for holding a reed in readiness. The central device in a drawing-in machine is a drawing-in device that typically guides the threads through reed, heald, drop wire and through components of a lease. On the "unloading side", i.e. after drawing-in has been effected, the drop wires and healds have to be removed from the vicinity of the drawing-in device in order to prevent backward congestion. In the drawing-in device, healds and drop wires are mostly transported fast over short distances in order to achieve a high drawing-in repetition rate. Once drawn in, the weaving accessories have to be pushed over mostly lengthy, rail-like guideways. Their removal is mostly slow, although the weaving accessories have to travel relatively large distances. These are typically 2 to 3 m, but sometimes distances of up to 6 m are required. On the "unloading side", drop wires and healds are often transported away parallel, in devices arranged beside each other. The present invention relates to the transport of weaving accessories from a pick-up position via the drawing-in position and on to the hand-over position. The invention relates advantageously to a module for the transport of drop wires, but healds are not excluded.

The WO9205303A1 discloses a device for handling weaving accessories, which continuously transports, in a guided manner, drop wires suspended on pins. Guide rails are intended to prevent the drop wires from falling off the pins. The aim of continuous transportation on the same pins and the associated reduction in interfaces is to reduce error sources and causes of trouble.

The EP1105558B1 enhances the WO9205303A1 in that the drop wires are firmly clamped between two clamping surfaces acting in opposite directions. The object is to create a special "springing" pattern repeat.

The EP777005A2 discloses a handling device for drop wires where, between separation and push-off, the drop wires are transferred several times to different holding elements. The various holding elements are to some extent linearly relocatable and also rotatable around an axis. The objective stated is to provide a highly reliable drawing-in machine.

The EP806506A2 discloses a device in which drop wires are removed from a magazine and supplied to a drawing-in device that is not specified further. A swingable pick-up element supports the supply of drop wires to the drawing-in device but is not configured to present the drop wire to the drawing-in device. Instead, the drop wire is merely passed on to a further holding element of the drawing-in device.

SUMMARY

Starting out from this prior art, the object of the present invention is to describe a handling device and a method for handling weaving accessories, which allow fast and reliable handling of the weaving accessories.

The device according to the invention for handling weaving accessories comprises at least one holding element for a weaving accessory. The at least one holding element comprises a contact surface for a weaving acceessory. The greater extension of the contact surface defines the longitudinal direction of the holding element and the lesser extension of the contact surface defines the lateral direction of the holding element. The at least one holding element is arranged pivotably around a first axis, which extends at right angles to the holding element's longitudinal direction, in order to move a weaving accessory at the holding element's contact surface from a pick-up position to a drawing-in position by pivoting the holding element around the first axis.

By means of the pivoting movement around the first axis, the weaving accessory is transported from the pick-up position to the drawing-in position without it is having to be released from the holding element and without the need for additional holding elements or guideways for transporting a weaving accessory. Reliability and productivity are thereby increased.

The at least one holding element is disposed pivotably around the first axis in such a manner that it can be moved on from the drawing-in position to a hand-over position and from there back to the pick-up position. The weaving accessory is not detached from the holding element's contact surface until the hand-over position is reached, thereby again ensuring its reliable transport. All in all, transport from the pick-up position to the hand-over position is highly reliable. In the pick-up position, the lateral direction of the holding element may be oriented parallel to the first axis. In the hand-over position, the lateral direction of the holding element may be oriented parallel to the first axis. In the drawing-in position, the lateral direction of the holding element may be oriented parallel to the first axis.

The first axis is spaced apart from the holding element's contact surface in the longitudinal direction of the holding element. As a result of the space between the axis of rotation and the contact surface, and thus also the weaving accessory, the distance over which the weaving accessory can be transported by the pivoting movement is greater. In this way, sufficient room is provided for the respective devices at the pick-up position, the drawing-in position and the hand-over position.

The holding element defines a second axis, which extends parallel to the longitudinal axis and, in the lateral direction, is disposed centrally in the contact surface and at a distance above the contact surface corresponding to an average thickness of a weaving accessory. The distance above the contact surface is measured at right angles to the longitudinal direction and to the lateral direction. An average thickness of a weaving accessory may be a few tenths of a millimeter. The thickness of weaving accessories such as drop wires may range from 0.2 mm to 1 mm. An average value may comprise, for example, 0.3 mm or 0.5 mm or any arbitrary values therebetween. The holding element can be pivoted around the second axis in order to orientate the weaving accessory for drawing-in, pick-up and hand-over. It is advantageous if the weaving accessories held ready in a stack are orientated in such a manner that, after the weaving accessory has been pivoted around the first axis, a thread is prevented from being drawn in because a narrow side of the weaving accessory faces towards the drawing-in device. A pivoting movement around the second axis can then advantageously orientate the weaving accessory such that a thread can be drawn through an appropriate hole in a wide side of the weaving accessory by the drawing-in device. A setup of this kind allows an advantageous arrangement of weaving-accessory stacks. The holding element may be disposed in such a manner that, via the positive control of a transmission arrangement, it can be pivoted simultaneously around the first and the second axis. The rotational movements around the first and second axes of rotation can only sweep through a limited angular range. More particularly, the holding element cannot perform a complete revolution around one of the rotational axes. In the drawing-in position, the lateral direction of the holding element cannot be oriented parallel to the first axis.

The first holding element comprises a first spring element and a second spring element in order to hold the weaving accessory therebetween, in the longitudinal direction of the holding element and under tensile stress, in a recess of the weaving accessory. Accordingly, the holding element can hold the weaving accessory non-positively by force. The force-effected connection ensures reliable transport. The weaving accessory may rest with a wide side on the holding element's contact surface. The holding element may also hold the weaving accessory, at least partially, by means of a form fit, for example at an outer edge. The first spring element may be disposed in such a manner that it can be displaced by a device element not arranged at the holding element in order to release the weaving accessory. The first spring element may be arranged in such a manner that it creates a form fit with the weaving accessory by means of its spring action. The spring force of the first spring element may act at right angles to the longitudinal direction and to the lateral direction. The second spring element may be arranged in such a manner that, by means of its spring force, it moves the weaving accessory in its longitudinal direction when the weaving accessory is released from the first spring element. The tensile stress in the weaving accessory may be effected by the spring of the second spring element.

The holding element's contact surface may have an opening so that, by means of the pivoting movement, the holding element can apply its contact surface to an outermost weaving accessory of a stack of weaving accessories and pick up the outermost weaving accessory from the stack. In addition or alternatively, the holding element with attached weaving accessory may be pivotable with its opening above a hand-over rail for the weaving accessory. The device may have a pusher element for each stack, which is configured to push an outermost weaving accessory located at the contact surface of the holding element longitudinally out from the stack and into the holding element. As this happens, the weaving accessory pretensions the second spring element and, by means of a form fit with the first spring element, is held to the holding element. Holding of the weaving accessory under tensile stress to the holding element may be realised using the procedure and set-up described below: A weaving accessory has a closed recess in its wide side. The recess is bounded in the drop wire's longitudinal direction by a first inner edge and a second inner edge. The first inner edge is located near to an end of the drop wire in its longitudinal direction. The holding element swings round to the outermost drop wire of the stack in such a way that the first inner edge of the drop wire's recess is in the vicinity of the first spring element and the second inner edge of the drop wire's recess is in the vicinity of the second spring element. Both inner edges are spaced from the respective spring element in the same orientation in the longitudinal direction. The drop wire is pushed longitudinally by a pusher element so that the first inner edge makes contact with the first spring element and the second inner edge with the second spring element. The first spring element may be displaced in the elevational direction, against the spring of the first spring element, by an end edge of the drop wire until the first spring element engages in the drop wire's recess and creates a form fit with the first inner edge of the drop wire's recess. The form fit prevents the drop wire from being pulled out under the first spring element. To release the drop wire, the first spring element must be displaced against its spring force by a device element disposed at the device remote from the holding element. The second spring element may be displaced in the longitudinal direction, against its spring force, by the second inner edge of the drop wire's recess. For as long as the first spring element secures the drop wire to the holding element, the second spring element exerts a tensile stress on the drop wire. This ensures that the drop wire is held securely to the holding element even during a pivoting movement that moves the drop wire over a long distance at high speed.

The device may have a plurality of identical holding elements disposed pivotably along the first axis, and staggered in the direction thereof, and pivotably around the first axis. Precisely one of a plurality of stacks and precisely one of a plurality of hand-over rails may be assigned to each holding element. The device may comprise two, four, six or eight correspondingly supported holding elements, stacks and hand-over rails. The use of a higher number of stacks enables a higher number of weaving accessories to be drawn in without the need to refill one of the stacks.

The method for handling weaving accessories applies at least one holding element for a weaving accessory, wherein the at least one holding element has a contact surface for a weaving accessory, the greater extension of the contact surface defining a longitudinal direction and the lesser extension of the contact surface defining a lateral direction of the holding element. The at least one holding element pivots around a first axis, which extends at right angles to the holding element's longitudinal direction. As a result of the holding element's pivoting movement around the first axis, a weaving accessory held to the holding element moves from a pick-up position to a drawing-in position.

The at least one holding element may be pivoted further around the first axis so that it is moved from the drawing-in position to a hand-over position and, after the weaving accessory has been handed over, back again to the pick-up position.

BRIEF DESCRIPTION OF THE DRAWINGS

In order to orientate the weaving accessory for the drawing-in, the first holding element may perform a rotational movement around the second axis simultaneously with the pivoting movement around the first axis from the pick-up position to the drawing-in position and/or from the drawing-in position to the hand-over position.

DETAILED DESCRIPTION

Figure 1:
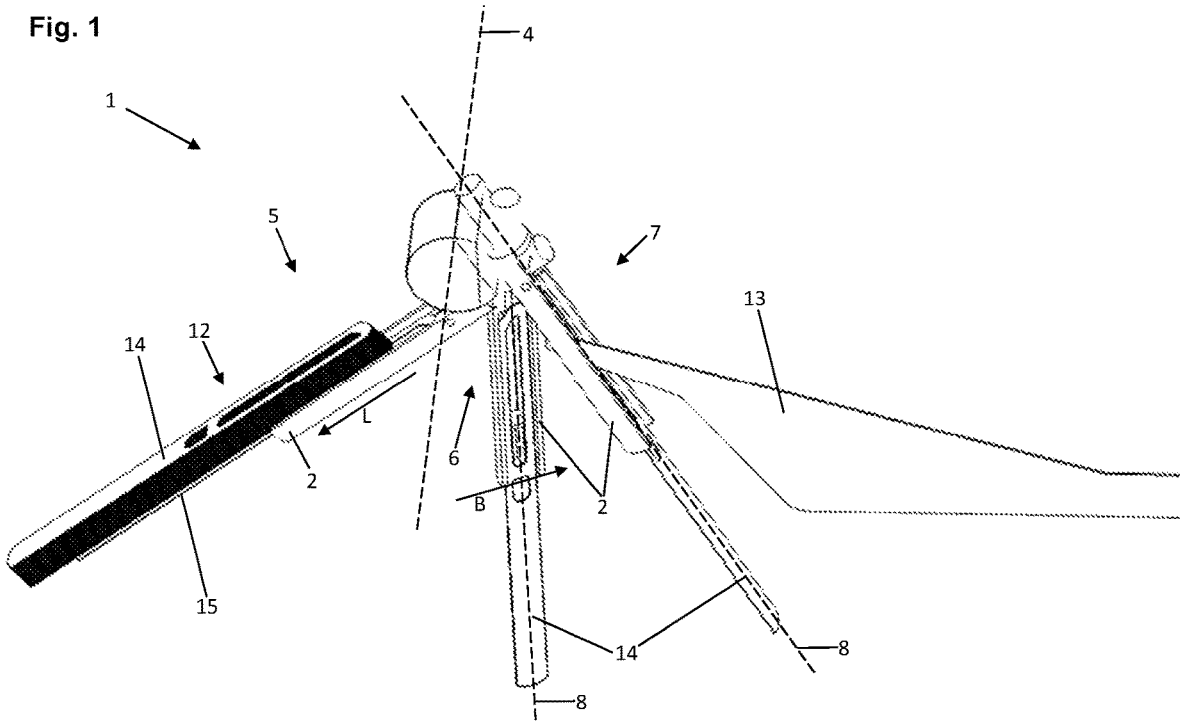
FIG. 1 shows a symbolic oblique view of the essential components of the device according to the invention.

FIG. 1 shows a symbolic oblique view of the essential components of the device 1 according to the invention. A holding element 2 is shown in three possible positions of its motion sequence. The holding element 2 is shown with an exemplary drop wire 14 for a warp stop motion. In the left-hand part of FIG. 1 the holding element 2 is shown in its pick-up position 5. The holding element is disposed under a stack 12 of drop wires 14, lying against an outermost drop wire. Compared to the other drop wires 14 of the stack 12, the outermost, in FIG. 1 the bottom, drop wire 15 has been displaced towards the first axis 4, in the opposite direction to the arrow indicating the longitudinal direction L of the holding element 2, and is consequently held to the holding element 2.

In the middle part of FIG. 1 the holding element 2 is shown in the drawing-in position 6. In this position, the lateral direction B of the holding element 2 is indicated with an arrow. It is evident from the symbolic, three-dimensional view shown in FIG. 1 that the holding element 2 with the drop wire 14 has been pivoted not only around the first axis 4 but also around the second axis 8. The first axis 4 and the second axis 8 are shown as broken lines.

In the right-hand part of FIG. 1 the same holding element 2 is shown in a third position, in the hand-over position 7. It is again evident that compared to the drawing-in position 6, the holding element has been pivoted again around the first axis 4 and the second axis 8. The hand-over rail 13 reaches through openings in the drop wire 14 and the contact surface 3 of the holding element (see FIG. 3). When the drop wire 14 in the hand-over position 7 is released by a non-portrayed device element, the drop wire is able to slide off on the incline of the hand-over rail 13. Thereafter, the holding element 2 can be swung back to the pick-up position 5 to pick up the next drop wire. The pivoting movement from the hand-over position 7 back to the pick-up position 5 may be effected on the same path as the swinging movement from the pick-up position 5 to the hand-over position 7.

Figure 2:
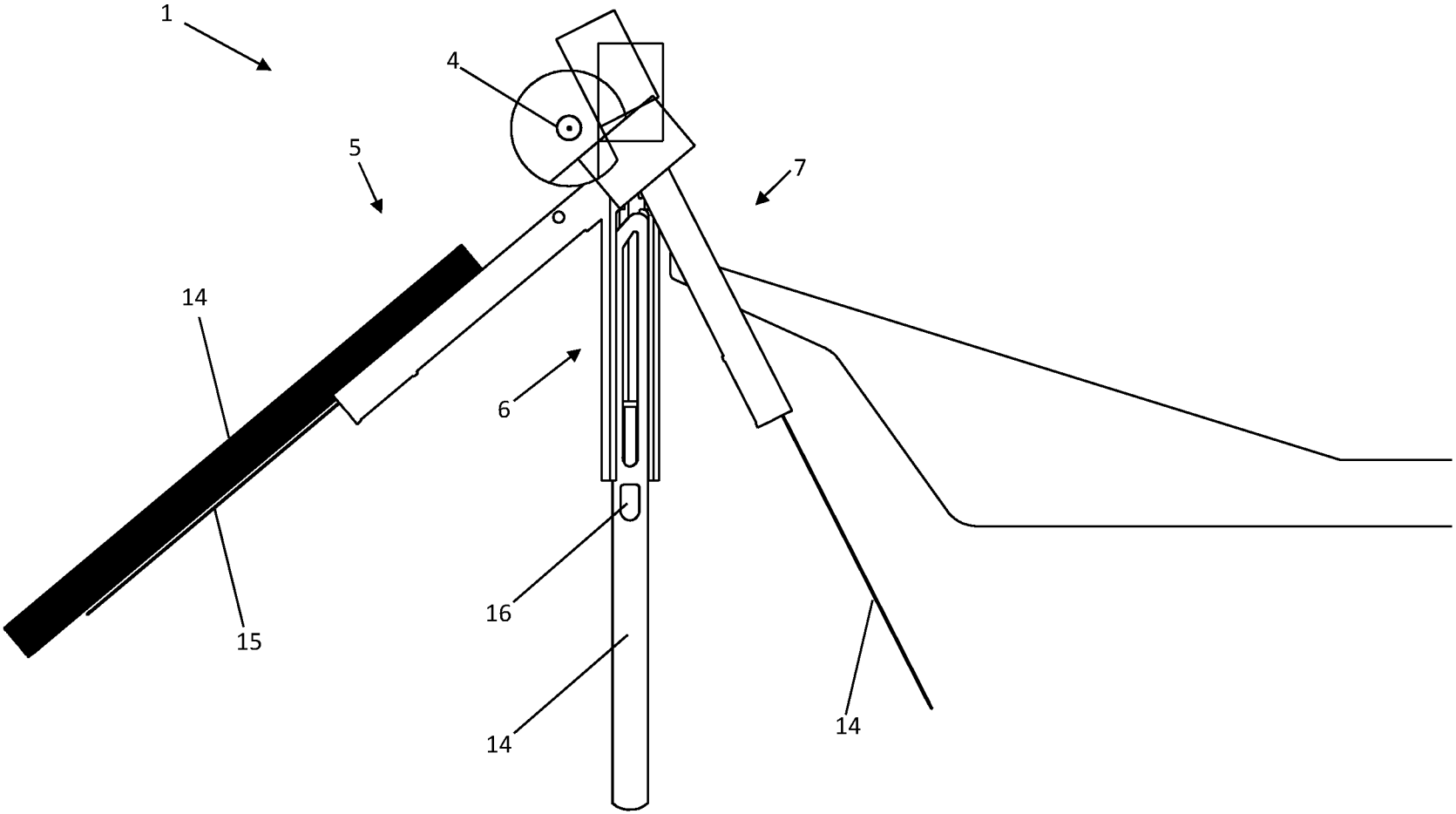
FIG. 2 shows the device of FIG. 1 as seen in the direction of the first axis.

FIG. 2, exactly like FIG. 1, shows the same single holding element 2 in the same three positions 5, 6 and 7 of its motion sequence. A portrayal has been selected in which the first axis 4 is aligned in the plane of the drawing, as shown by the symbol with a dot in a circle. This view is intended to complement FIG. 1 and to make the three-dimensional arrangement of the exemplary device 1 clearer. In this top view, only a narrow side of the drop wire 14 and of the outermost drop wire 15 are recognizable when the holding element 2 is in the pick-up position 5 and the hand-over position 7 respectively. By contrast, with the drop wire in the drawing-in position 6, the wide side of the drop wire 14 is visible. A thread can thus be drawn, in known manner, through the thread eye 16 of the drop wire in the direction of the first axis.

Figure 3:
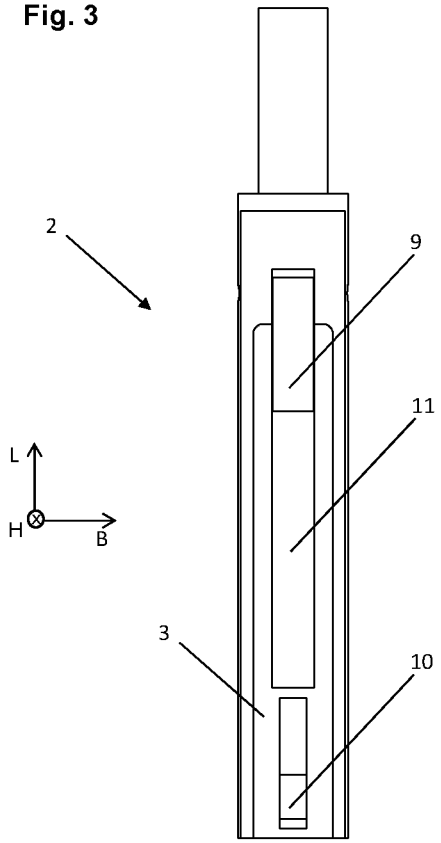
FIG. 3 shows a symbolic top view of the contact surface of a holding element according to FIGS. 1 and 2.

FIG. 3 shows a symbolic top view of the contact surface 3 of a holding element 2 according to FIGS. 1 and 2. The contact surface 3 has an opening 11, which can be swung into position above a hand-over rail 13. It is also possible, however, to swing the opening 11 into position above elements of a stack 12 that hold the drop wires 14 via openings of the drop wires 14. A drop wire 14 can initially be positioned above the contact surface 3 of the holding element 2 when the latter is swung into position. By means of displacement in the longitudinal direction L, a drop wire 14 can be pushed under the first spring element 9 and simultaneously, with a second inner edge 19 of a recess 17, push the second spring element 10 upwards, thereby pre-tensioning it. The first spring element 9 is disposed movably, in an elevational direction H at right angles to the longitudinal direction L and to the lateral direction B, at the holding element 2. The spring force of the first spring element 9 acts in the elevational direction H. The first spring element 9 is disposed at the holding element 2 in such a manner that it can be pushed by a drop wire 14, which is resting on the contact surface 3 and is pushed in the longitudinal direction L against the first spring element 9, against the spring force in the elevational direction H, so that the drop wire 14 can be pushed through between the contact surface 3 and the first spring element 9. If the first spring element 9 engages in a recess 17 of the drop wire 14, the first spring element 9 will then reliably safeguard the drop wire 14 from being pulled back. The first spring element 9 will then move in the elevational direction H on account of the spring force and can thereby create a form fit with a first inner edge 18 of the recess 17 in the drop wire 14. The second spring element 10 is disposed at the holding element 2 in such a manner that it only penetrates through the contact surface 3 in a central portion thereof in the lateral direction B. A drop wire 14, whose recess 17 is above the second spring element 10, will be pushed with the inner edge 19 of the recess 17 against the second spring element 10 and can then displace the second spring element 10, in longitudinal direction L, towards the first spring element 9. The drop wire 14 is thus held under tension in the longitudinal direction L, between the first spring element 9 and the second spring element 10, to the holding element 2.

Figure 4:
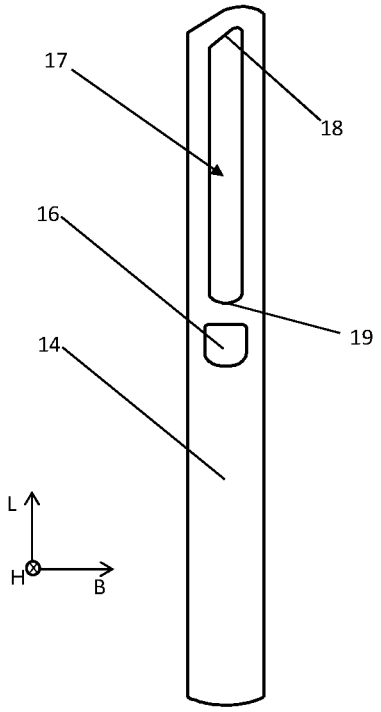
FIG. 4 shows a symbolic top view of the wide side of an exemplary drop wire.

FIG. 4 shows a symbolic top view of the wide side of an exemplary drop wire 14. The drop wire 14 has a recess 17, which is limited in the longitudinal direction L of the drop wire 14 by a first inner edge 18 and a second inner edge 19. The first inner edge 18 is located near to an end of the drop wire 14 in its longitudinal direction L. The drop wire 14 has a thread eye 16 through which a thread is drawn during the drawing-in process.

List of reference numerals

| | |
|---|---|
| 1. | Device |
| 2. | Holding element |
| 3. | Contact surface of the holding element (2) |
| 4. | First axis |
| 5. | Pick-up position |
| 6. | Drawing-in position |
| 7. | Hand-over position |
| 8. | Second axis |
| 9. | First spring element |
| 10. | Second spring element |
| 11. | Opening in the holding element (2) |
| 12. | Stack |
| 13. | Hand-over rail |
| 14. | Drop wire |
| 15. | Outermost drop wire of the stack (12) |

-continued

| List of reference numerals | |
|---|---|
| 16. | Thread eye of the drop wire 14 |
| 17. | Recess in the drop wire (14) |
| 18. | First inner edge of the recess 17 in the drop wire 14 |
| 19. | Second inner edge of the recess 17 in the drop wire 14 |
| L | Longitudinal direction of the holding element (2) |
| B | Lteral direction of the holding element (2) |
| H | Elevational direction of the holding element (2) |

The invention claimed is:

1. A device (1) for handling a weaving accessory (14), the device comprising:

at least one holding element (2) configured to pick up and move the weaving accessory (14), the weaving accessory (14) including an opening (16) configured to receive a thread therethrough, said at least one holding element (2) comprising a contact surface (3) for the weaving accessory (14) and a greater extension of the contact surface (3) defining a longitudinal direction (L) and a lesser extension of the contact surface (3) defining a lateral direction (B) of the at least one holding element (2);

wherein the at least one holding element (2) is disposed pivotably around a first axis (4), which extends orthogonally to the longitudinal direction (L) of the at least one holding element (2) to move the weaving accessory (14) engaged with the contact surface (3) of the at least one holding element (2) from a pick-up position (5), wherein the at least one holding element (2) is operable to pick up the weaving accessory (14), to a drawing-in position (6), wherein the weaving accessory (14) is positioned to have the thread drawn into the opening (16) of the weaving accessory (14), by pivoting the at least one holding element (2) around the first axis (4); and wherein the at least one holding element (2) defines a second axis (8) which extends parallel to the longitudinal direction (L) and is disposed centrally with respect to the lateral direction (B) of the contact surface (3) and above the contact surface (3), and the at least one holding element (2) is pivotable around the second axis (8) for positioning the weaving accessory (14) in the pick-up position, the drawing-in position and a hand-over position (7).

2. The device (1) according to claim 1, wherein the at least one holding element (2) is disposed pivotably around the first axis (4) in such a manner that it is movable from the drawing-in position (6) to the hand-over position (7) and back again to the pick-up position (5).

3. The device (1) according to claim 1, wherein the first axis (4) is spaced apart from the contact surface (3) of the at least one holding element (2) in the longitudinal direction (L) of the at least one holding element (2).

4. The device (1) according to claim 1, wherein the at least one holding element (2) comprises a first spring element (9) and a second spring element (10) configured to hold the weaving accessory (14) therebetween in a recess (17) of the weaving accessory (14) and in the longitudinal direction (L) of the at least one holding element (2) under tensile stress.

5. The device (1) according to claim 1, wherein the contact surface (3) of the at least one holding element (2) comprises an opening (11) configured to allow at least one of:

the contact surface (3) of the at least one holding element (2) to be applied to the weaving accessory (14), wherein the weaving accessory (14) is an outermost weaving accessory (15) of a stack (12) of weaving accessories for picking up the outermost weaving accessory (15) from the stack (12) by pivoting the at least one holding element (2) around the first axis (4); and the at least one holding element (2) with the attached outermost weaving accessory (15) to pivot above a hand-over rail (13) for the outermost weaving accessory (15).

6. The device (1) according to claim 1, wherein a plurality of the at least one holding elements (2) are pivotably disposed about the first axis (4) and staggered in a direction thereof, and one stack (12) of a plurality of stacks (12) of weaving accessories and one hand-over rail (13) of a plurality of hand-over rails (13) corresponds to each of the plurality of holding elements (2).

7. A method for handling weaving accessories, in which at least one holding element (2) for a weaving accessory (14) of the weaving accessories is applied, said at least one holding element (2) comprising a contact surface (3) for the weaving accessory (14) and a greater extension of the contact surface (3) defining a longitudinal direction (L) and a lesser extension of the contact surface (3) defining a lateral direction (B) of the at least one holding element (2), the method comprising:

pivoting the at least one holding element (2) around a first axis (4), which extends orthogonally to the longitudinal direction (L) of the at least one holding element (2), moving the weaving accessory (14), the weaving accessory (14) including an opening (16) configured to receive a thread therethrough, held by the at least one holding element (2) from a pick-up position (5) to a drawing-in position (6), wherein the weaving accessory (14) is positioned to have the thread drawn into the opening (16) of the weaving accessory (14), by the pivoting of the at least one holding element (2) around the first axis (4); and pivoting the at least one holding element (2) further around the first axis (4) so that it is moved from the drawing-in position (6) to a hand-over position (7) and, after the weaving accessory (14) has been handed over, moving the at least one holding element (2) back to the pick-up position (5).

8. The method according to claim 7, further comprising pivoting the at least one holding element (2) around a second axis (8) simultaneously with the pivoting movement around the first axis (4) from the pick-up position (5) to the drawing-in position (6) and/or from the drawing-in position (6) to the hand-over position (7).

* * * * *